United States Patent [19]

Harvey

[11] 4,414,490

[45] Nov. 8, 1983

[54] DISPLAY PANEL

[75] Inventor: Edgar L. Harvey, Jamesburg, N.J.

[73] Assignee: Burroughs Corporation, Detroit, Mich.

[21] Appl. No.: 355,677

[22] Filed: Mar. 8, 1982

[51] Int. Cl.[3] ..... H05B 37/00; H05B 39/00

[52] U.S. Cl. ..... 315/169.4; 315/169.2

[58] Field of Search ..... 315/169.2, 169.4; 340/768, 769, 773, 776, 794

[56] References Cited

U.S. PATENT DOCUMENTS 4,253,044 2/1981 Smith ..... 315/169.2

4,336,535 6/1982 Albertine, Jr. ..... 315/169.4

4,342,993 8/1982 Holz ..... 315/169.4

4,373,157 2/1983 Holz et al. ..... 315/169.4

*Primary Examiner*—David K. Moore

*Assistant Examiner*—Robert E. Wise

*Attorney, Agent, or Firm*—Kevin R. Peterson; Edmund M. Chung; Robert A. Green

[57] ABSTRACT

A display panel and method of operating it wherein the panel includes columns of both scan cells and display cells which alternate with columns of only scan cells, and the columns of scan cells are scanned more rapidly than the columns of scan and display cells.

7 Claims, 7 Drawing Figures

DISPLAY PANEL

BACKGROUND OF THE INVENTION

One type of dot matrix SELF-SCAN display panel is described in U.S. Pat. No. Re. 29,858 dated Dec. 5, 1978, of Donald E. Miller, which is incorporated herein by reference. This panel includes rows and columns of cathode glow gas cells made up of strip-like, thick-film cathode electrodes screened on the panel base plate in operative relation with transverse anode electrodes formed on the face plate of the panel. Each cathode strip is divided into scan portions and display portions in operation.

Another type of dot matrix SELF-SCAN display panel is described in a copending application of Edgar L. Harvey entitled DISPLAY PANEL, Ser. No. 335,753, filed Dec. 30, 1981, which is incorporated herein by reference. This type of panel is similar to the panel described above except that the cathodes are metal strips, which are formed by a winding operation, and the anodes are wires seated in slots in the panel base plate. As in the Miller panel, the cathode surfaces are divided into scan and display areas in operation.

Both types of panels are desirable display devices; however, the second type of panel has some manufacturing advantages. However, because of the constraints imposed by the requirements of the scanning operation in these panels, a panel of the second type cannot be made as a direct replacement for a panel of the first type by known principles of construction and operation of SELF-SCAN panels.

For example, in one panel of the first type, the display cells have a center-to-center spacing of 0.1 inch. A panel of the second type having this spacing of the display cells cannot be made by known principles. The present invention solves this problem.

The principles of the operation of SELF-SCAN panels are set forth in U.S. Pat. No. 3,989,981 of James A. Ogle and George E. Holz, dated Nov. 2, 1976, which is incorporated herein by reference.

DESCRIPTION OF THE INVENTION

Figure 1:
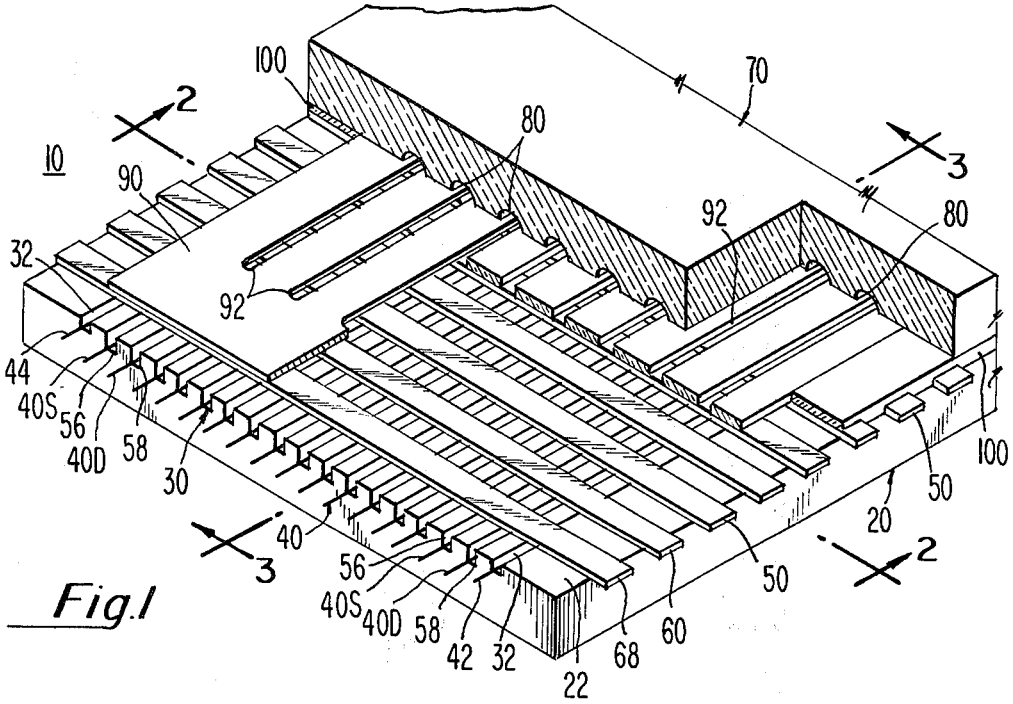
FIG. 1 is a perspective cut-away view of a display panel embodying the invention.
Figure 2:
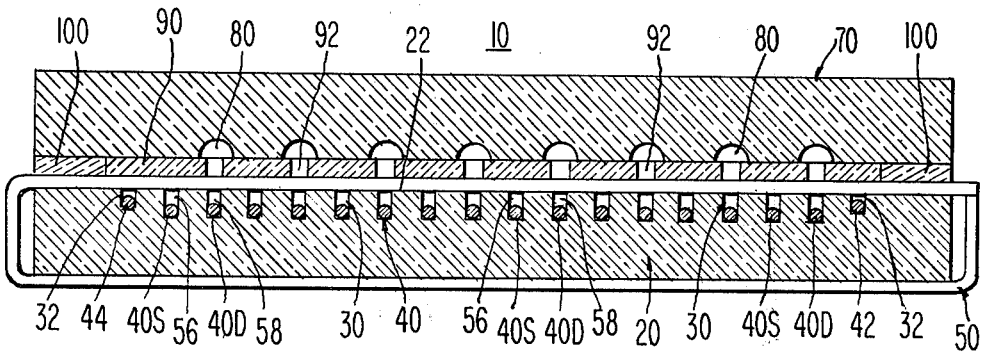
FIG. 2 is a sectional view of the panel of FIG. 1 shown assembled, and along the lines 2—2 in FIG. 1.
Figure 3:
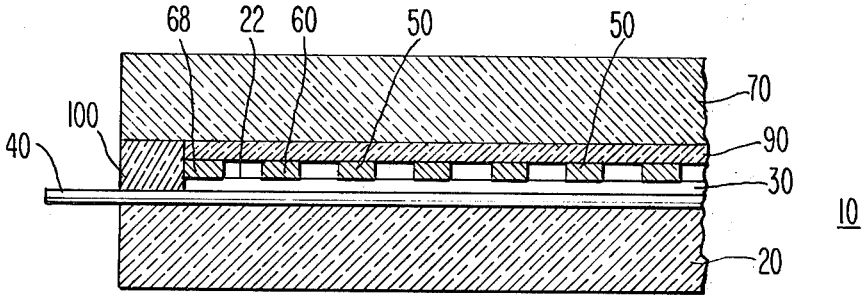
FIG. 3 is a sectional view of a portion of the panel of FIG. 1 taken along the lines 3—3 in FIG. 1.

The principles of the invention are illustrated herein with respect to the type of SELF-SCAN panel described and claimed in the above-identified application of Edgar L. Harvey. However, the principles are applicable to other types of panels.

A display panel 10 embodying the invention includes a glass base plate 20 having a plurality of parallel longitudinal slots 30 which extend across and into the top surface 22 thereof. Anode wire electrodes 40S and 40D are seated in the slots 30, with the anodes 40S and 40D alternating with each other. Anodes 40S are scan anodes, and anodes 40D are display anodes.

Cathode electrodes 50, in the form of narrow parallel metal strips, are disposed on the top surface of the base plate, oriented transverse to the anodes 40. The location at which each cathode crosses an anode 40 defines a column of cells; where each scan anode 40S is crossed by a cathode is a scan cell 56, and where each display anode 40D is crossed by a cathode is a display cell 58. Thus, in each column, the scan cells alterate with the display cells, and, in the rows of cells, the scan cells are aligned, and the display cells are aligned.

A SELF-SCAN panel such as panel 10 also includes a reset cathode electrode 60 adjacent to the first cathode 50A in the array of cathodes 50. The reset cathode forms a column of reset cells with the anodes 40.

A keep-alive mechanism is also provided, comprising a strip electrode 68 adjacent to the reset cathode 60 and operable with two electrodes 42 and 44 seated in slots 32 in the base plate adjacent to the first and last anodes 40. Electrodes 42 and 44 extend under and lie in operative relation with electrode strip 68 with which they provide the desired keep-alive action.

In making the above-described base plate assembly, the anode wires 40 are preferably formed by a winding operation, and all of the strip electrodes 50, 60 and 68 are preferably formed by a winding operation.

The panel 10 includes a glass face plate 70 having an inner surface which is chemically etched to provide a plurality of parallel shallow slots or depressions 80 having a depth of about 3 to 4 mils. The slots 80 are disposed transverse to the cathodes 50 and overlie each row of display cells. This inner surface of the face plate 70 is coated with a thin layer 90 of black insulating material to provide light contrast. This layer is about one mil thick, and it covers the entire inner surface of the face plate, but not the slots or despresions 80. In this area, the layer 90 has display slots 92 which are aligned with the slots 80 in the face plate. These slots 92 in coating 90 are also aligned with the rows of display cells. The rest of the layer 90 overlies the scan cells and blocks them from being seen through the face plate 70. The face plate is hermetically sealed to the base plate and seated on the cathodes 50, 60, and electrode 68 by means of a thin glass frit sealing ring 100 which is screened on the edge of the face plate at a thickness of about 1 mil. The anode slots 30 are filled with the sealing material along the edges of the panel so that the panel is completely hermetically sealed.

The panel 10 is filled in any suitable manner with an ionizable gas such as neon or argon and a small quantity of xenon.

Considering the operation of panel 10, operating potentials are applied to keep-alive electrodes 68 and 42, 44 so that electrodes 42 and 44 are glow cathodes and generate excited particles. Positive operating potential is applied to all of the scan anodes 40S, and relatively more negative potential is applied to reset cathode 60. These potentials, aided by the keep-alive particles, cause the turn-on of the column of reset cells formed by the crossing of reset cathode 60 and the scan anodes 40S. This represents the beginning of a scanning cycle.

The scanning cycle then is carried out by the application of operating potential to each of the cathodes 50 in turn, beginning with the cathodes adjacent to the reset cathode 60. This turns on all of the scan cells in each column of cells sequentially. With all scan cells in a column turned on, there is cathode scan glow present at the lower surface of the overlying cathode 50 above all of the scan anodes 40S. This scan glow is not visible to a viewer either because it is at the lower surface of each cathode; or, if it moves to the upper surface, it is not visible because of black coating 90. As the columns of scan cells are then turned on sequentially, information signals of sufficient magnitude are applied to selected display anodes 40D, and this causes glow to transfer from a scan slot 30 to a display slot 30 across the land between them to the portion of the top surface of the cathode overlying the selected display anode(s) 40D. This glow is visible to a viewer because it is aligned with slots 92 and 80. As the scanning operation is carried out through the panel and selected display cells are caused to glow, an apparently stationary but changeable message is visible in the energized display cells. This briefly describes the operation of the panel described in the above Harvey application.

Figure 4:
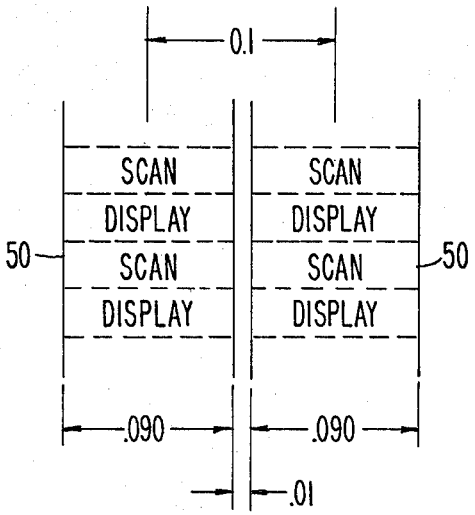
FIG. 4 is a plan view of two cathodes of the type used in one form of SELF-SCAN panel and illustrating the operation thereof.

As noted above, a display panel having a center-to-center spacing between display cells of about 0.1 inch is desirable and can be readily achieved in types of panels such as that described in the Miller patent, but not in the panel described above in Harvey. For proper scan transfer between cathode strips in Harvey's panel such as panel 10, the spacing between cathodes 50 should be about 0.010 inch and with metal strip cathodes, this calls for cathodes of about 0.09 inch in width to provide a center-to-center spacing of 0.1 inch between display cells. This is illustrated in FIG. 4. However, with a cathode as wide as 0.09 inch, problems in scanning may be present and improper panel operation may result.

Figure 5:
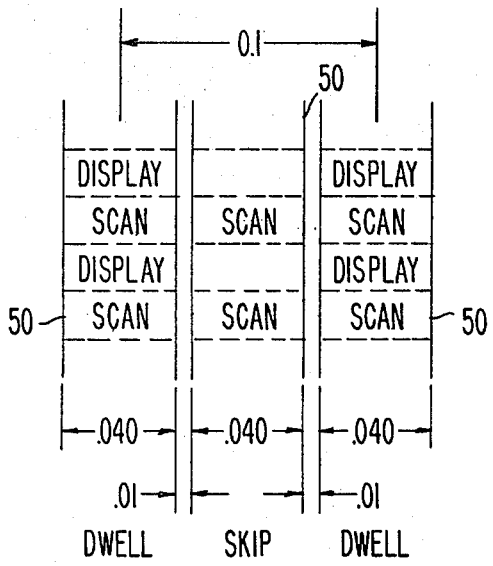
FIG. 5 is a plan view of three cathodes used in the panel of FIG. 1 and illustrating the operation thereof.
Figure 6:
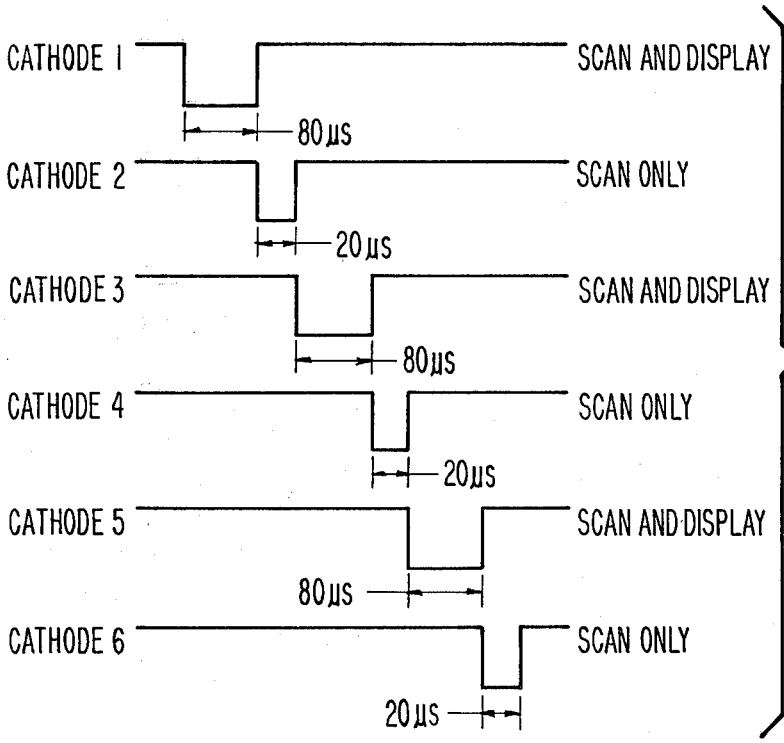
FIG. 6 is a set of timing curves illustrating the operation of the invention.

According to the invention, this problem is solved, referring to FIG. 5, by providing, in panel 10, cathodes 50 having a width of 0.040 inch spaced apart 0.010 inch. With this arrangement, there is a center-to-center spacing of 0.100 inch between each cathode and, not the adjacent cathode, but the second cathode away from it. To go along with this new cathode size and spacing, a new mode of operation is employed. According to the invention, the panel 10 is scanned in normal fashion; that is, each cathode and each column of scan cells is turned on in sequence. However, as the scanning operation is carried out from column to column, display signals are applied to every other column of cells, that is, to the first, third, and fifth columns, and not to the second, fourth and sixth columns. Thus, as illustrated by the timing curves of FIG. 6, in a scanning cycle, the first cathode is driven negative with respect to the scan anodes, and all scan cells are turned on and held on for perhaps 80 μs. During this time, one or more display cells can be energized. Then, the second cathode is energized to turn on all of its scan cells, but no display signals are applied. This is just a scan operation and can be held on for 20 μs. Now, the third cathode is energized to turn on its column of scan cells, and it is held on for 80 μs, and selected ones of its display cells can be turned on as required. It is noted that these scan cells are spaced by 0.100 inch center-to-center from the display cells of the first cathode. This mode of operation is continued with the fourth cathode turned on for about 20 μs to perform only a scan operation, the fifth cathode turned on for about 80 μs to perform a scan and display operation, and so forth throughout the a panel. This scan and display operation is performed continually throughout the panel, and the display cells which are energized present an apparently stationary but changeable message.

Figure 7:
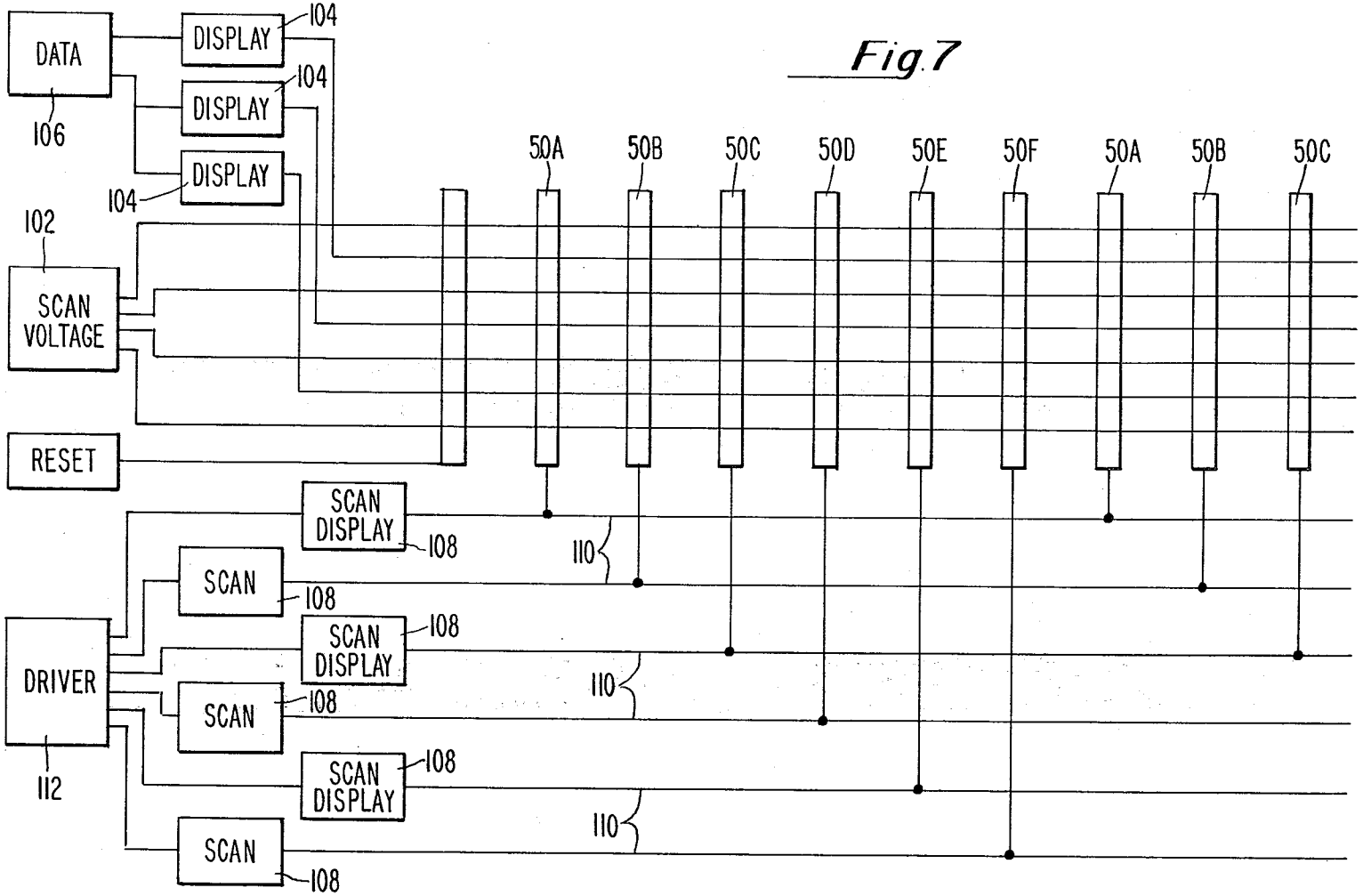
FIG. 7 is a schematic representation of the panel of the invention and an electronic circuit with which it may be operated.

This mode of operation of the panel 10 may be carried out in the type of electronic circuit shown schematically in FIG. 7. In the circuit, the scan anodes 40S are connected to a suitable source 102 of positive D.C. potential, and each of the display anodes 40D is connected to a display driver 104. A suitable source 106 of data signals is connected to each of the display drivers. The cathodes 50 are connected in groups, as is well known in the art of operating SELF-SCAN panels, and, in this mode of operation, it is convenient to connect the cathodes in groups of six, as illustrated. A drive circuit 108 is connected to each of the cathode busses 110, which interconnects a group of cathodes, and a sequencing drive circuit 112 is provided to turn on each of the cathode drivers 108 sequentially and for the proper length of time. Suitable synchronizing circuits (not shown) are provided as required.

What is claimed is:

1. A display panel comprising a gas-filled envelope made up of a glass base plate and a glass viewing face plate, anode and cathode means forming a plurality of columns of gas cells, the first, third, fifth, seventh, etc. columns of gas cells including both scan cells which do not perform a display function and display cells which perform a display function, the second, fourth, sixth, eighth, etc. columns of cells including only scan cells which do not perform a display function.

2. A display panel comprising a gas-filled envelope made up of a glass base plate and a glass viewing face plate, anode and cathode means forming a series of columns of cathode glow discharge gas cells, selected ones of the columns of gas cells including both scan cells which do not perform a display function and display cells which perform a display function, and between each two of said selected columns of cells there being a column of cells including only scan cells which do not perform a display function but facilitate the transfer of cathode glow along the columns of cells.

3. The panel defined in claim 2 and including means coupled to said anode and cathode means for applying scan and display signals to the columns of cells which include both scan cells and display cells, and applying only scan signals to said columns of cells which include only scan cells.

4. The panel defined in claim 2 and including means coupled to said anode and cathode means for applying scan and display signals for a first period of time to the columns of cells which include both scan cells and display cells, and applying signals for a second period of time to said columns of cells which include only scan cells.

5. The panel defined in claim 2 and including means coupled to said anode and cathode means for applying scan and display signals for a first period of time to the columns of cells which include both scan cells and display cells, and applying signals for a second shorter period of time to said columns of cells which include only scan cells.

6. The method of operating a display panel which comprises a gas-filled envelope made up of a glass base plate and a glass viewing face plate, and anode and cathode means forming a series of columns of gas cells, selected ones of the columns of gas cells including both scan cells which do not perform a display function and display cells which perform a display function, and between each two of said selected columns of cells there being a column of cells including only scan cells which do not perform a display function but facilitate the transfer of cathode glow along the columns of cells, the method comprising the steps of first applying electrical signals to the first column of cells in the series of columns of cells to turn on all of the scan cells and selected ones of the associated display cells as dictated by the input information, second applying electrical signals to the next column of scan cells in the series of columns of cells, which is a column of only scan cells and turning on all of such scan cells, and repeating said first and second steps throughout said series of columns of cells and repeating said steps continually throughout said series of columns of cells to provide an apparently stationary but changeable message in the selected display cells.

7. The method defined in claim 6 wherein said second step is shorter in time than said first step.

* * * * *